US008113801B2

(12) United States Patent
Chen et al.

(10) Patent No.: US 8,113,801 B2
(45) Date of Patent: Feb. 14, 2012

(54) FAN AND MOTOR THEREOF

(75) Inventors: Hou-Chu Chen, Taoyuan Hsien (TW); Shui-Fa Tsai, Taoyuan Hsien (TW); Hung-Yi Liang, Taoyuan Hsien (TW); Lee-Long Chen, Taoyuan Hsien (TW); Chin-Chu Hsu, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 668 days.

(21) Appl. No.: 12/249,464

(22) Filed: Oct. 10, 2008

(65) Prior Publication Data

US 2009/0269225 A1 Oct. 29, 2009

(30) Foreign Application Priority Data

Apr. 25, 2008 (TW) ..... 97115306 A

(51) Int. Cl.
*F04B 17/03* (2006.01)

(52) U.S. Cl. ..... 417/420; 417/423.7; 310/156.38; 310/216.114

(58) Field of Classification Search ..... 417/420, 417/423.7; 310/156.38, 216.114, 62, 64, 310/216.117, 270, 156.36, 156.32, 198
See application file for complete search history.

(56) References Cited

U.S. PATENT DOCUMENTS 5,666,011 A * 9/1997 Hong ..... 310/40.5
6,040,650 A * 3/2000 Rao ..... 310/268
2007/0252451 A1* 11/2007 Shibuya et al. ..... 310/64

* cited by examiner

*Primary Examiner* — Karabi Guharay
*Assistant Examiner* — Elmito Breval
(74) *Attorney, Agent, or Firm* — Muncy, Geissler, Olds & Lowe, PLLC

(57) ABSTRACT

A fan includes an inner rotor motor, which includes a housing, a rotor assembly and a stator assembly. The rotor assembly includes a rotor, which includes blades and is accommodated in the housing. The stator assembly is disposed in the housing corresponding to the rotor assembly. The stator assembly includes a coil disposed around the rotor. The coil is a flat helix structure formed by a continuous wire, and the flat helix structure forms a cylindrical plane perpendicular to a radius plane of the motor.

18 Claims, 2 Drawing Sheets

FAN AND MOTOR THEREOF

BACKGROUND OF THE INVENTION

This Non-provisional application claims priority under 35 U.S.C. §119(a) on Patent Application No(s). 097115306, filed in Taiwan, Republic of China on Apr. 25, 2008, the entire contents of which are hereby incorporated by reference.

FIELD OF INVENTION

The present invention relates to a fan and a motor thereof. More particularly, the present invention relates to the coil configuration of a fan and an inner rotor motor thereof.

DESCRIPTION OF THE RELATED ART

Since the fan applied to the current electronic apparatus or system has become smaller, it is necessary to enhance the heat dissipation efficiency of the fan within the limited space of the product. To achieve this goal, it is an applicable way to adjust the blade area of the fan.

In general, the motor of the fan divided into an outer-rotor motor and an inner-rotor motor according to the dispositions of the rotor and stator. For example, the conventional inner-rotor fan uses an inner-rotor motor for driving the blades to rotate. However, since the silicon steel sheet and windings of the stator occupy a certain part of the space between the frame and blades. Thus, the areas of the outlet and inlet of the fan are restricted accordingly, thereby decreasing the air flux of the fan. In addition, the windings must be wound on the silicon steel sheets so that the producing and manufacturing costs of the fan are increased.

Moreover, the conventional minimized DC motor includes the windings and magnetic rings without the magnetic conductive yoke. Therefore, the motor may have the drawbacks of worse efficiency and magnetic leakage. In addition, since the conventional DC motor has the design without offset, the motor may be uneasily enabled when the rotor is located at the enabling dead point.

SUMMARY OF THE INVENTION

In view of the foregoing, the present invention is to provide a fan and a motor thereof that have simplified winding configuration of the stator so as to decrease the producing and manufacturing costs and improve the efficiency of the fan.

To achieve the above, the present invention discloses a fan including a motor which includes a housing, a rotor assembly and a stator assembly. The rotor assembly includes a rotor, which includes blades and is accommodated in the housing. The stator assembly is disposed in the housing corresponding to the rotor assembly. The stator assembly includes a coil disposed around the rotor. The coil is a flat helix structure formed by a continuous wire, and the flat helix structure forms a cylindrical plane perpendicular to a radius plane of the motor.

As mentioned above, the fan and the motor of the present invention have the coil, which is disposed around the rotor and is a flat helix structure formed by a continuous wire. Thus, the magnetic pole disposition and the winding configuration of the stator in the motor of the present invention are changed. By this configuration, the inner space of the fan is efficiently used so as to increase the area for accommodating additional blades. The present invention not only change the conventional configuration of the stator, which occupies more inner space of the frame, but also simplify the winding process and reduce the manufacturing time for the winding process, thereby speeding up the assembling process and decreasing the manufacturing cost. The present invention also has two magnetic conductive structures, thus the magnetic path can be smoother and the magnetic flux of the magnetic ring and winding can be increased. Accordingly, the efficiency of the motor can be improved.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
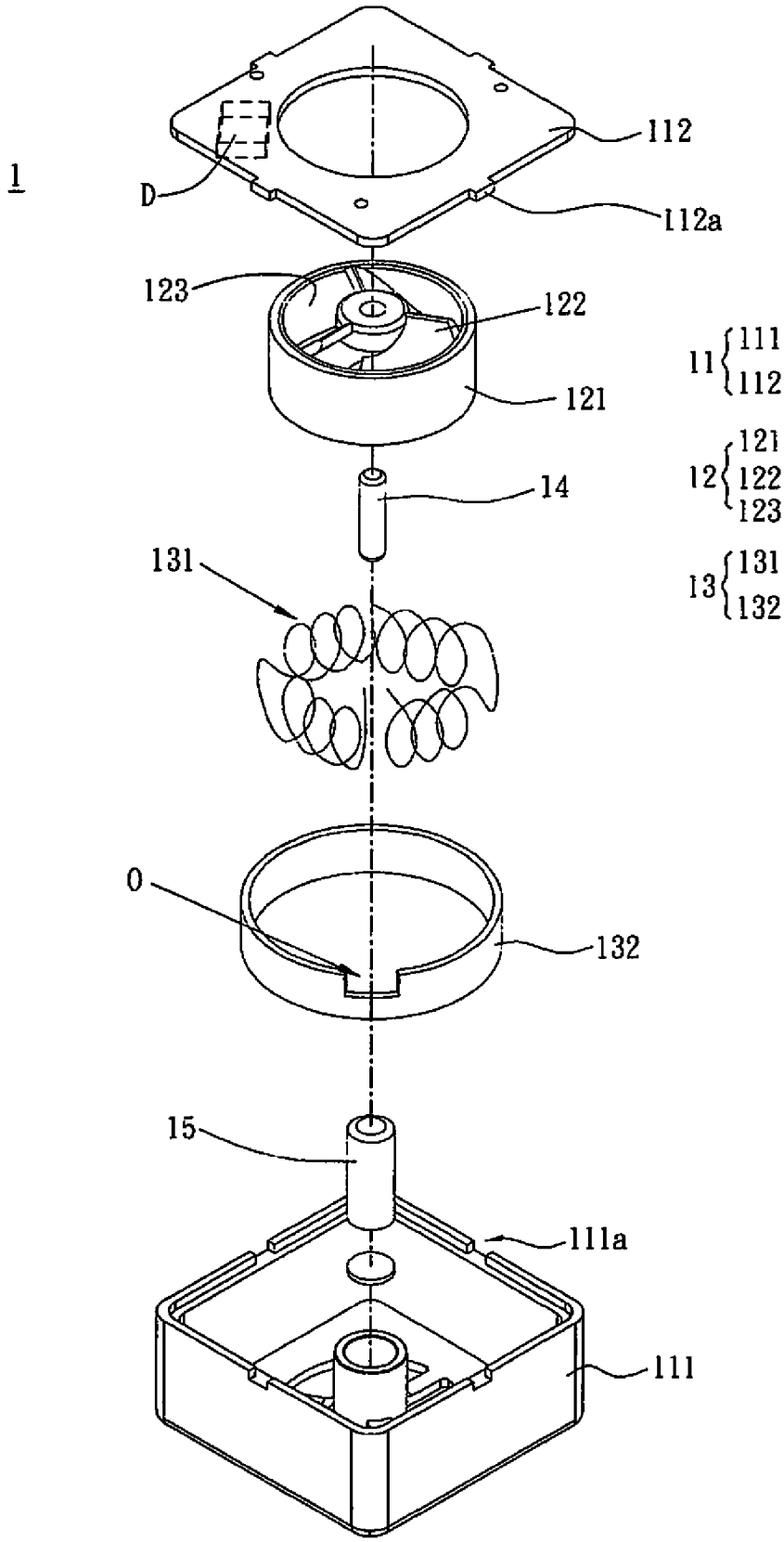
FIG. 1 is an exploded illustration showing a fan and an inner-rotor motor according to an embodiment of the present invention.
Figure 2:
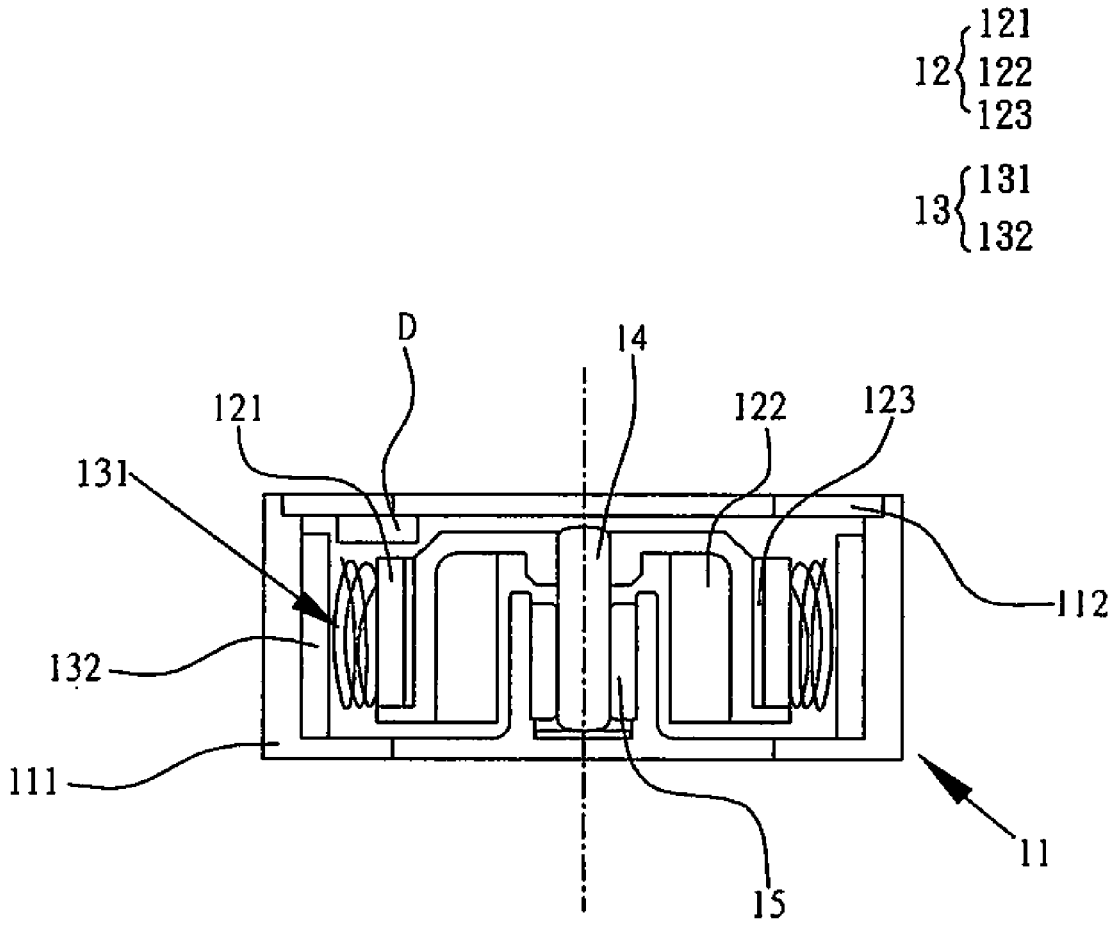
FIG. 2 is a sectional illustration showing the assembled fan of FIG. 1.

With reference to FIG. 1, a fan according to an embodiment of the present invention includes an inner-rotor motor, which has a housing 11, a rotor assembly 12 and a stator assembly 13. The rotor assembly 12 includes a rotor 121, which has several blades 122 and is accommodated in the housing 11. In addition, the rotor 121 can be telescoped within a magnetic element, or the rotor 121 can be directly made of a magnetic material without the disposition of the magnetic element. A first magnetic conductive element 123 is disposed on an inner surface of the rotor 121 for providing a closed magnetic loop. The stator assembly 13 is disposed in the housing 11 corresponding to the rotor assembly 12. The stator assembly 13 includes a coil 131 disposed around the rotor 121. The coil 131 is a flat helix structure formed by a continuous wire, and the flat helix structure forms a cylindrical plane perpendicular to a radius plane of the motor. In details, the flat helix structure includes a plurality of spiral segments, and the center axis of each spiral segment is located on the radius plane. In this embodiment, the center axis of the spiral segment is perpendicular to the shaft of the rotor 121 and passes through the shaft.

The above-mentioned inner-rotor motor further includes a shaft 14 and a bearing 15, which are disposed in the housing 11. The shaft 14 is telescoped within the bearing 15. The coil 131, which is a flat helix structure disposed around the rotor 121, forms a plurality of induced magnetic zones. The winding numbers of adjacent two parts of the coil 131 corresponding to adjacent two induced magnetic zones are different, so that the magnetic forces of adjacent two induced magnetic zones are different. Thus, the rotor 121 can be biased due to the different magnetic forces, thereby enabling the fan 1. In addition, the winding directions of adjacent two parts of the coil corresponding to adjacent two induced magnetic zones are different, so that the adjacent two induced magnetic zones generate reverse magnetic lines. The reverse magnetic lines can be acted with the rotor 121 with magnetic force so as to generate the rotational torque. The rotor 121 with magnetic force itself or the magnetic element of the rotor 121 has a plurality of magnetic poles, which are disposed corresponding to the above-mentioned induced magnetic zones.

In addition, the stator assembly 13 further includes a second magnetic conductive element 132, which is made of magnetic conductive yoke. The second magnetic conductive element 132 has an opening O, which is disposed between any two adjacent induced magnetic zones so as to allow a part of the magnetic lines to be leaked out. Thus, the rotor assembly 12 and the stator assembly 13 can be biased to start the rotor 121 to rotate.

The housing 11 includes a main body 111 and a cover body 112 connected with each other. The material of the main body 111 and the cover body 112 includes metal or a plastic material. The cover body 112 can be a circuit board, which has a driving device D. The driving device D can be, for example, a surface mount technology (SMT) electronic element disposed between the stator assembly 13 and the cover body 112. The main body 111 includes at least one first fixing structure 111*a*, and the cover body 112 includes at least one second fixing structure 112*a* disposed corresponding to the first fixing structure 111*a*. The first fixing structure 111*a* is disposed on a periphery of the main body 111, and the second fixing structure 112*a* is disposed on a periphery of the cover body 112. The first fixing structure 111*a* and the second fixing structure 112*a* are a set of a recess and a protrusion. That is, when one of the first fixing structure 111*a* and the second fixing structure 112*a* is a protrusion, the other one thereof is a recess.

In summary, the fan and motor of the present invention have the coil, which is disposed around the rotor and is a flat helix structure formed by a continuous wire. Thus, the disposition of the induced magnetic zones and the winding configuration of the stator in the motor of the present invention modified compared to conventional stator changed. By this configuration, the inner space of the fan can be efficiently used so as to increase the area for accommodating additional blades. The present invention not only change the conventional configuration of the stator, which occupies more inner space of the frame, but also simplify the winding process and reduce the manufacturing time for the winding process, thereby speeding up the assembling process and decreasing the manufacturing cost. The present invention also has two magnetic conductive structures, thus the magnetic path can be smoother and the magnetic flux of the magnetic ring and winding can be increased. Accordingly, the efficiency of the motor can be improved.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A motor, comprising:

a housing;

a rotor assembly comprising a rotor accommodated in the housing; and a stator assembly, disposed in the housing corresponding to the rotor assembly and comprising a coil disposed around the rotor and a second magnetic conductive element, wherein the coil is a flat helix structure formed by a continuous wire, and the flat helix structure forms a cylindrical plane perpendicular to a radius plane of the motor, and wherein the coil forms a plurality of induced magnetic zones, the winding numbers of adjacent two parts of the coil corresponding to adjacent two of the induced magnetic zones are different so that the magnetic forces of adjacent two induced magnetic zones are different; and wherein the second magnetic conductive element comprises an opening, and the opening is disposed between the adjacent two induced magnetic zones.

2. The motor according to claim 1, further comprising a bearing, wherein the rotor assembly further comprises a shaft coupled to the rotor, the shaft and the bearing are disposed in the housing, and the shaft is telescoped within the bearing.

3. The motor according to claim 1, wherein the rotor assembly further comprises a first magnetic conductive element disposed on an inner surface of the rotor.

4. The motor according to claim 1, wherein the second magnetic conductive element is a magnetic conductive yoke.

5. The motor according to claim 1, wherein the housing comprises a main body and a cover body connected with each other, the cover body is a circuit board having a driving device, and the driving device is a surface mount technology electronic element disposed between the stator assembly and the cover body.

6. The motor according to claim 5, wherein the main body comprises at least one first fixing structure, and the cover body comprises at least one second fixing structure disposed corresponding to the first fixing structure in which they are made of metal or a plastic material.

7. The motor according to claim 6, wherein the first fixing structure is disposed on a periphery of the main body and the second fixing structure is disposed on a periphery of the cover body, and the second fixing structure is a recess when the first fixing structure is a protrusion, or the second fixing structure is a protrusion when the first fixing structure is a recess.

8. The motor according to claim 1, wherein the rotor assembly further comprises a magnetic element or the rotor comprises a magnetic material.

9. The motor according to claim 1, wherein the motor is an inner-rotor motor.

10. A fan, comprising:

a housing; and a motor comprising:

a rotor assembly comprising a rotor, wherein the rotor comprises blades and is accommodated in the housing; and a stator assembly disposed in the housing corresponding to the rotor assembly and comprising a coil disposed around the rotor and a second magnetic conductive element, wherein the coil is a flat helix structure formed by a continuous wire, and the flat helix structure forms a cylindrical plane perpendicular to a radius plane of the motor, and wherein the coil forms a plurality of induced magnetic zones, the winding numbers of adjacent two parts of the coil corresponding to adjacent two of the induced magnetic zones are different so that the magnetic forces of adjacent two induced magnetic zones are different; and wherein the second magnetic conductive element comprises an opening, and the opening is disposed between the adjacent two induced magnetic zones.

11. The fan according to claim 10, further comprising a bearing, wherein the rotor assembly further comprises a shaft coupled to the rotor, the shaft and the bearing are disposed in the housing, and the shaft is telescoped within the bearing.

12. The fan according to claim 10, wherein the rotor assembly further comprises a first magnetic conductive element disposed on an inner surface of the rotor.

13. The fan according to claim 10, wherein the second magnetic conductive element is a magnetic conductive yoke.

14. The fan according to claim 10, wherein the housing comprises a main body and a cover body connected with each other, the cover body is a circuit board having a driving device, and the driving device is a surface mount technology electronic element disposed between the stator assembly and the cover body.

15. The fan according to claim 14, wherein the main body comprises at least one first fixing structure and the cover body comprises at least one second fixing structure disposed corresponding to the first fixing structure, and the main body and the cover body comprises metal or a plastic material.

16. The fan according to claim 15, wherein the first fixing structure is disposed on a periphery of the main body, the second fixing structure is disposed on a periphery of the cover body, the second fixing structure is a recess when the first fixing structure is a protrusion, or the second fixing structure is a protrusion when the first fixing structure is a recess.

17. The fan according to claim 10, wherein the rotor assembly further comprises a magnetic element or the rotor comprises a magnetic material.

18. The fan according to claim 10, wherein the motor is an inner-rotor motor.

* * * * *